US012060727B2

(12) United States Patent
Thrush

(10) Patent No.: US 12,060,727 B2
(45) Date of Patent: Aug. 13, 2024

(54) RACKABLE PANEL ASSEMBLY AND METHODS OF ASSEMBLY THEREOF

(71) Applicant: Paul Thrush, Queensland (AU)

(72) Inventor: Paul Thrush, Queensland (AU)

( * ) Notice: Subject to any disclaimer, the term of this patent is extended or adjusted under 35 U.S.C. 154(b) by 178 days.

(21) Appl. No.: 17/474,043

(22) Filed: Sep. 13, 2021

(65) Prior Publication Data

US 2022/0081930 A1 Mar. 17, 2022

(30) Foreign Application Priority Data

Sep. 14, 2020 (AU) ..... 2020903287

(51) Int. Cl.
*E04H 17/14* (2006.01)

(52) U.S. Cl.
CPC ..... *E04H 17/1448* (2021.01); *E04H 17/1439* (2013.01)

(58) Field of Classification Search
CPC ..... E04H 17/1417; E04H 17/1426; E04H 17/1439; E04H 17/1445; E04H 17/1447; E04H 17/1448; E04H 17/1469; E04H 17/185; E04F 11/1817; E04F 2011/1819; E04F 2011/1821; E04F 2011/1823; E04F 2011/1825; E04F 2011/1827; E04F 2011/1829; E04F 2011/1831
See application file for complete search history.

(56) References Cited

U.S. PATENT DOCUMENTS 5,443,244 A * 8/1995 Gibbs ..... E04H 17/1439 256/22
5,660,378 A * 8/1997 Schall ..... E04H 17/1439 256/22
5,873,564 A * 2/1999 Bisch ..... E04H 17/1439 256/59
6,631,887 B1 10/2003 Walmsley
7,021,607 B1 * 4/2006 Alexander ..... E04H 17/1439 256/70

(Continued)

FOREIGN PATENT DOCUMENTS

CA 2684043 A1 * 4/2011 ..... E04H 17/1417
EP 1234933 A1 8/2022

(Continued)

OTHER PUBLICATIONS

International Type Search for Related United Kingdom Patent Application No. GB2112619.8 dated Apr. 25, 2022, 1 page.

(Continued)

*Primary Examiner* — Amber R Anderson
*Assistant Examiner* — Kevin J Baynes
(74) *Attorney, Agent, or Firm* — McDonald Hopkins LLC

(57) ABSTRACT

A rackable panel assembly is provided includes including a plurality of vertical members each having a rail engagement opening defined therein; and at least one rail having sets of opposed openings spaced along a longitudinal length of the rail, each set of opposed openings adapted to receive a vertical member of said plurality of vertical members therethrough and at least partially cover the rail engagement opening of said vertical member. The assembly further includes at least one coupling member adapted to be at least partially received in each said vertical member for pivotally coupling the vertical member to the at least one rail.

12 Claims, 8 Drawing Sheets

(56) References Cited

U.S. PATENT DOCUMENTS

| | | | | |
|---|---|---|---|---|
| 7,025,335 | B2 * | 4/2006 | Zhu | E04H 17/1488 403/252 |
| 7,347,412 | B1 * | 3/2008 | Zhu | E04H 17/1488 403/252 |
| 7,819,390 | B2 * | 10/2010 | Godwin | E04H 17/1447 256/22 |
| 8,177,195 | B2 * | 5/2012 | Schall | F16B 7/0446 256/22 |
| 8,413,332 | B2 * | 4/2013 | Duffy | E04H 17/1417 29/897.31 |
| 8,833,737 | B2 * | 9/2014 | Langenwalter | E04H 17/1426 256/67 |
| 8,899,555 | B2 * | 12/2014 | Sherstad | E04H 17/1439 256/65.01 |
| 9,027,909 | B1 | 5/2015 | Peyton et al. | |
| 9,404,283 | B1 | 8/2016 | Chong-Yi | |
| 9,435,134 | B2 * | 9/2016 | Walmsley | E04H 17/1447 |
| 9,689,177 | B2 * | 6/2017 | Langenwalter | E04H 17/1426 |
| 9,695,612 | B2 * | 7/2017 | Batts, III | E04H 17/1439 |
| 9,995,059 | B2 * | 6/2018 | Langenwalter | E04H 17/1426 |
| 10,060,136 | B2 * | 8/2018 | Milanowski | E04F 11/1817 |
| 10,648,194 | B2 * | 5/2020 | Lo | E04H 17/1439 |
| 10,794,081 | B2 * | 10/2020 | Ash | E04H 17/1413 |
| 11,035,147 | B2 * | 6/2021 | Burt | E04H 17/1439 |
| 2003/0201432 | A1 * | 10/2003 | Norman | E04F 11/1817 256/65.08 |
| 2005/0067609 | A1 * | 3/2005 | Walmsley | E04H 17/1439 256/65.01 |
| 2005/0127344 | A1 | 6/2005 | Graber | |
| 2007/0158630 | A1 * | 7/2007 | Lo | E04F 11/181 256/59 |
| 2009/0238640 | A1 * | 9/2009 | Godwin | F16B 7/0473 29/525.08 |
| 2010/0044662 | A1 * | 2/2010 | Walmsley | E04H 17/1447 29/428 |
| 2013/0264532 | A1 * | 10/2013 | Goodman | E04H 17/1439 256/65.03 |
| 2018/0266119 | A1 * | 9/2018 | Schneider | E04F 11/1842 |
| 2019/0211579 | A1 * | 7/2019 | Burt | E04H 17/1426 |
| 2021/0293049 | A1 * | 9/2021 | Burt | E04H 17/1426 |
| 2022/0064983 | A1 * | 3/2022 | McCugh | E04H 17/1482 |

FOREIGN PATENT DOCUMENTS

| | | | | |
|---|---|---|---|---|
| GB | 2345303 | A * | 7/2000 | E04H 17/1439 |
| GB | 2393741 | A * | 4/2004 | E04H 17/1439 |
| GB | 2444930 | A | 6/2008 | |
| WO | 2006/122371 | A1 | 11/2006 | |
| WO | 2007/119039 | A1 | 10/2007 | |
| WO | WO-2009033092 | A2 * | 3/2009 | E01F 13/022 |

OTHER PUBLICATIONS

International Type Search for Related Provisional Australian Application No. 2020903287 dated May 14, 2021, 14 pages.

* cited by examiner

RACKABLE PANEL ASSEMBLY AND METHODS OF ASSEMBLY THEREOF

TECHNICAL FIELD

The present invention relates to a panel assembly and methods of assembly thereof. In particular, the present invention concerns a rackable panel assembly for following a gradient or slope of a support surface.

BACKGROUND

A fence is a structure that generally encloses an area or demarcates a boundary.

One popular type of fence for its aesthetic appearance is the picket fence. Generally, a picket fence includes two or more rails spanning across a number of vertically standing fence posts and a plurality of upright pickets individually mounted to the rails in a spaced arrangement.

When erecting a picket fence along sloped or graded terrain, it is desirable for aesthetic reasons that the rails substantially match the slope or gradient of the terrain and the pickets remain generally upright and substantially parallel with the fence posts.

Typically, current practice is to first measure the slope or gradient of the terrain and then fabricate the picket fence as modular panels off site. The fabrication usually includes individually welding the pickets to the rails at a desired orientation such that the rails will match the slope or gradient of the terrain and the pickets will be generally upright when the modular panels are assembled on site.

However, a problem with current practice is that there is little room for error in any of the measurements. Further, if the dimensions or angles of any of the modular panels are incorrect, the panels may need to be returned to the manufacturer for correction all at additional cost and time.

Rackable fence systems have been developed in which the pickets are pivotally mounted to the rails. The pickets in such systems are typically pivotally coupled to each rail with a screw or bolt. Apart from the additional cost of individually pivotally mounting each picket to the rails, the visible screws or bolts detract from the aesthetic appearance and structural integrity of the fence.

SUMMARY OF INVENTION

Embodiments of the present invention provide a rackable panel assembly, a rackable panel, a rackable fence, and methods of assembly thereof, which may at least partially address one or more of the problems or deficiencies mentioned above or which may provide the public with a useful or commercial choice.

According to a first aspect of the present invention, there is provided a rackable panel assembly including:

- a plurality of vertical members each having a pair of opposed ends and at least one sidewall extending longitudinally therebetween and having a rail engagement opening defined therein;
- at least one rail having a pair of opposed ends and at least one sidewall extending longitudinally therebetween, said at least one sidewall defining sets of opposed openings spaced along a longitudinal length of the at least one rail, each set of opposed openings adapted to receive a vertical member of said plurality of vertical members therethrough and at least partially overlap or cover the rail engagement opening of said vertical member;

- at least one coupling member adapted to be at least partially received in each said vertical member for pivotally coupling the vertical member to the at least one rail, said coupling member having at least one protrusion and a biasing member for biasing the at least one protrusion outwardly from the rail engagement opening in a direction perpendicular to the length of the at least one rail to pivotally couple the vertical member to the at least one rail,
- wherein at least one opening of each set of opposed openings is elongate so that said vertical member received therethrough is pivotable relative to the at least one rail.

According to a second aspect of the present invention, there is provided a rackable panel assembly including:

- a plurality of vertical members each having a pair of opposed ends and at least one sidewall extending longitudinally therebetween and having a rail engagement opening defined therein;
- at least one rail having a pair of opposed ends and at least one sidewall extending longitudinally therebetween, said at least one sidewall defining openings spaced along a longitudinal length of the at least one rail, each opening adapted to receive a vertical member of said plurality of vertical members therethrough and at least partially overlap or cover the rail engagement opening of said vertical member;
- at least one coupling member adapted to be at least partially received in each said vertical member for pivotally coupling the vertical member to the at least one rail, said coupling member having at least one protrusion and a biasing member for biasing the at least one protrusion outwardly from the rail engagement opening in a direction perpendicular to the length of the at least one rail to pivotally couple the vertical member to the at least one rail,
- wherein each opening defined in the rail is elongate so that said vertical member received therethrough is pivotable relative to the at least one rail.

According to a third aspect of the present invention, there is provided a coupling member for pivotally coupling a vertical member and a rail of a rackable panel assembly together, said coupling member adapted to be at least partially received in the vertical member, said coupling member including at least one protrusion and a biasing member to bias the at least one protrusion outwardly from a rail engagement opening defined in the vertical member in a direction perpendicular to a length of the at least one rail to pivotally couple the vertical member to the rail.

Advantageously, the rackable panel assembly of the present invention is able to be readily assembled either on site or off site and fitted to match the slope or gradient of an underlying support surface without any risk of error and without any delays or additional costs associated with the correction of the error. Each vertical member is pivotally coupled to a rail by a coupling member that provides structural integrity to the panel without detracting from the aesthetic appearance of the panel.

As indicated above, the panel assembly of the present invention is for use as modular fence panel in assembling a rackable fence, preferably a rackable picket fence. It will therefore be convenient to hereinafter describe the panel assembly with reference to this example application as a rackable fence panel assembly. However, a person skilled in the art will appreciate that the panel assembly is capable of broader applications and applies to any barrier panel comprising a plurality of vertical members pivotally coupled to one or more rails, such as, e.g., balustrades.

The panel assembly of the present invention includes a plurality of vertical members pivotally coupled to at least one rail adapted to extend between adjacently positioned fence posts, preferably two or more rails extending extend substantially parallel to one another. In use, the vertical members may be pivotable relative to the rails so that the rails may be racked to extend substantially parallel to a slope or gradient of an underlying support surface and the vertical members may remain generally upright.

The vertical members and the rail or rails may be pivotable relative to one another about any suitable range of rotation. For example, the rails may be pivotable about 0°, about ±1°, about ±2°, about ±3°, about ±4°, about ±5°, about ±6°, about ±7°, about ±8°, about ±9°, about ±10°, about ±11°, about ±12°, about ±13°, about ±14°, about ±15°, about ±16°, about ±17°, about ±18°, about ±19°, about ±20°, about ±21°, about ±22°, about ±23°, about ±24°, about ±25°, about ±26°, about ±27°, about ±28°, about ±29°, about ±30°, about ±31°, about ±32°, about ±33°, about ±34°, about ±35°, about ±36°, about ±37°, about ±38°, about ±39°, about ±40°, about ±41°, about ±42°, about ±43°, about ±44° or even about ±45° from a horizontal while the vertical members remain substantially vertical. Typically, the rail or rails may pivotable over a range from 0° to about ±35° relative to a horizontal plane while the vertical members remain substantially vertical.

The at least one rail may be of any size, shape and construction and fabricated from any material or materials suitably adapted to extend between adjacent fence posts and support the plurality of pickets mounted thereto.

The rail may be of unitary construction or may be formed from two or more rail pieces joined together, preferably the former.

The rail may be of tubular or solid construction, preferably the former.

As indicated, the rail may include a pair of opposed ends and at least one sidewall extending longitudinally therebetween, preferably in a linear direction. In some embodiments, the at least one sidewall may be curved such that the rail may have a substantially circular, oval-shaped or rounded cross-sectional shape. In other embodiments, the rail may include more than one sidewall thereby providing the rail with a triangular, rectangular, pentagonal, hexagonal or octagonal cross-sectional shape.

In preferred embodiments, the rail may have a substantially rectangular cross-sectional shape with four sidewalls extending between the opposed ends. The four sidewalls may include an upper wall, an opposed lower wall and a pair of opposed sidewalls.

The rail may be formed from plastic or metal material or materials, preferably metal material or materials, more preferably steel or aluminium.

The rail may be fabricated in any suitable way. For example, the rail may be machine folded or rolled from a sheet of material, such as, e.g., sheet metal, or may be an extrusion.

The rail may be of any suitable length to support the plurality of vertical members in a spaced arrangement and span between adjacent fence posts. For example, the rail may have a length, as defined between the opposed ends, ranging from between about 500 mm and about 15,000 mm, typically between about 1,000 mm and about 10,000 mm.

The ends of the rail may be adapted to be connectable either directly or indirectly with fence posts, preferably pivotally connectable so that the rail may be angled relative to the fence post to extend substantially parallel with a slope or gradient of an underlying support surface.

In some embodiments, the end of the rail and a fence post may be connected together by a connecting mechanism or part of a connecting mechanism. For example, a first part of the connecting mechanism associated with the end of the rail may mate, or engage, with a second part of the connecting mechanism associated with the fence post.

The connecting mechanism may include mateable male and female portions that couple together, including interference fit (snap fit) connections or bayonet-type connections, for example.

In some embodiments, the connecting mechanism may include a male formation associated with the end of the rail and configured to be inserted into, or coupled with, a female formation associated with the fence post. Conversely, in other embodiments, the connecting mechanism may include a female formation associated with an end of the rail and configured to receive, or be coupled with, a male formation associated with the fence post.

In other embodiments, the end of the rail and the fence post may be connectable via a joining component adapted to be operatively associated with the end of the rail and the fence post.

In yet other embodiments, the fence post may include a rail mount adapted to at least partially receive and couple with the end of the rail, preferably via a pivot pin. The rail mount may advantageously enable the rail to be pivotable relative to the fence post so that the rail may be angled to extend substantially parallel with a slope or gradient of the underlying support surface.

Like the rail, the vertical members may each be of any size, shape and construction and may be formed from any material or materials suitably adapted to be mounted to the at least one rail and extend in generally upright or substantially vertical orientation.

Each vertical member may be in the form of a picket, a baluster, a spindle or a shaft, preferably a picket.

Each vertical member may be of unitary construction or may be formed from two or more member pieces joined together.

Each vertical member may be of tubular or solid construction, preferably the former.

As indicated, each vertical member may include a pair of opposed ends and at least one sidewall extending longitudinally therebetween, preferably in a linear direction. In some embodiments, the at least one sidewall may be curved such that the vertical member may have a substantially circular, oval-shaped or rounded cross-sectional shape. In other embodiments, the vertical member may include more than one sidewall thereby providing the vertical member with a triangular, rectangular, pentagonal, hexagonal or octagonal cross-sectional shape.

In preferred embodiments, each vertical member may have a substantially rectangular cross-sectional shape with four sidewalls extending between the opposed ends. The opposed ends may include a lower end and an opposed upper end. The four sidewalls may include a pair of opposed outwardly facing walls and a pair of opposed sidewalls.

Like the rail, each vertical member may be formed from plastic or metal material or materials, preferably metal material or materials, more preferably steel or aluminium.

Each vertical member may be fabricated in any suitable way. For example, each vertical member may be machine folded or rolled from a sheet of material, such as, e.g., sheet metal, or may be an extrusion.

Each vertical member may be of any suitable height to function as a barrier and be aesthetically pleasing. For example, each vertical member may have a height, as defined between the opposed ends, ranging from between about 300 mm and about 5,000 mm, typically between about 900 mm and about 2,500 mm.

In some embodiments, the vertical members spaced across the panel assembly may all be of a same height. In other embodiments, one or more of the vertical members may be of differing heights to provide an aesthetically pleasing effect, such as, e.g., one or more curves.

The opposed ends of the vertical member may be open or closed.

In some embodiments, at least one of the opposed ends of the vertical member may be crimped and trimmed to shape or flattened and trimmed to shape.

In other embodiments, at least one of the opposed ends of the vertical member may include a decorative cap, preferably the upper end.

In yet other embodiments, at least one of the opposed ends of the vertical member may include a cap for closing or sealing off the end.

The decorative cap or cap may connect to the end of the vertical member in any suitable way.

For example, in some embodiments, the cap and the end of the vertical member may be connected together by a connecting mechanism or part thereof. The connecting mechanism may be as previously described.

In other embodiments, the decorative cap or cap may be frictionally fitted in the end.

As indicated, each vertical member includes a rail engagement opening defined in the at least one sidewall. The rail engagement opening is adapted to be at least partially covered by the rail when the vertical member is coupled to the rail.

The rail engagement opening may be of any size and shape suitably adapted for the at least one protrusion of the coupling member to at least partially protrude outwards from, preferably towards an inner surface of the rail, more preferably towards the inner surface of one of the opposed sidewalls of the rail. The coupling member will be described in detail later.

The rail engagement opening may preferably be defined in at least one of the outwardly facing walls of the vertical member. The rail engagement opening may be defined at a location along a height of the vertical member corresponding to a position of the rail when the vertical member is received through the opening or opposed openings defined in the rail.

The rail engagement opening may typically be a shaped opening, preferably an elongate opening extending longitudinally in a direction at least partially along a length of the vertical member.

In some embodiments, each vertical member may include more than one rail engagement opening. For example, each vertical member may include two, three, four, five, six, seven or even eight rail engagement openings.

In some such embodiments in which each vertical member is coupled to at least two rails extending substantially parallel to one another, each vertical member may include at least two rail engagement openings each respectively corresponding to a rail.

In other such embodiments, each vertical member may include a set of opposed rail engagement openings for coupling the vertical member to a rail. The opposed rail engagement openings may preferably be defined in the pair of opposed outwardly facing walls.

Like the rail engagement opening, the openings defined in the rail may each be sized and shaped for receiving a vertical member therethrough.

The openings may be defined in at least one of the upper wall and the lower wall of the rail depending on whether the rail is located at a top, a bottom or therebetween on the panel assembly.

For example, in embodiments in which the rail extends along a bottom of the panel assembly, the openings may be defined in the upper wall of the rail. As indicated, the openings may be elongate so that a vertical member received therethrough may be pivotable relative to bottom rail. The opening may be elongate in a direction extending along a length of the rail.

Conversely, in embodiments in which the rail extends along a top of the panel assembly, the openings may be defined in the lower wall of the rail. Again, and as indicated, the openings may be elongate so that a vertical member received therethrough may be pivotable relative to the top rail. The opening may be elongate in a direction extending along a length of the rail.

Likewise, in embodiments in which the rail extends across the panel assembly in a location between the top and the bottom, the openings may be arranged in sets of opposed openings. The openings of each set may be positioned to at least partially align with one another, preferably on the upper wall and the opposed lower wall of the rail.

Each set of openings may include an upper opening defined in the upper wall of the rail and an opposed lower opening defined in the lower wall of the rail. Again, and as indicated, at least one of the openings of each set may be elongate so that a vertical member received therethrough may be pivotable relative to the at least one rail, preferably the lower opening or the opening defined in the lower wall of the rail. Preferably, the elongate opening may be longer relative to the opposed opening in a direction extending along the length of the rail.

The rail may include any suitable number of openings spaced along a length of the rail, preferably evenly spaced. A person skilled in the art will appreciate that the number of openings may correspond to the number of vertical members that may be mounted to the rail and this may correspond to a length of the rail.

The openings, including the rail engagement opening and the opposed openings, may be formed in the vertical member and the rail respectively in any suitable way. For example, the openings may be formed through one or more of laser cutting, router cutting, water jet cutting, jig saw cutting, plasma cutting, punching any other process capable of formed a defined opening. Preferably, the openings may be punched in the vertical members and rails.

As indicated above, the assembly includes at least one coupling member for pivotally coupling each vertical member to a rail, preferably such that the vertical member is pivotable relative to the rail but at least partially prevented from axial movement relative to the rail. The at least one coupling member may be of any suitable size, shape and construction and may be formed from any suitable material or materials.

Generally, the at least one coupling member may be formed from plastic or metal material or materials.

The coupling member may be sized and shaped to be at least partially received in a vertical member. In some embodiments, the coupling member may be at least partially received in the vertical member via an end of the vertical member. In other embodiments, the coupling member may be at least partially received in the vertical member via the rail engagement opening.

As indicated above, the coupling member preferably includes at least one protrusion and a biasing member for biasing the at least one protrusion at least partially outwards from the rail engagement opening for pivotally coupling the vertical member to the rail.

The at least one protrusion of the coupling member may at least partially protrude outwardly from the rail engagement opening in a direction perpendicular to a length of the at least one rail, preferably towards an inner surface of one of the pair of opposed sidewalls of the rail.

The at least one protrusion may have an elongate shape, typically sized and shaped to at least partially protrude through the rail engagement opening.

The protrusion may include an upper wall and an opposed lower wall interconnected by a pair of opposed end walls and a pair of opposed sidewalls extending longitudinally therebetween.

The protrusion may include rounded corners extending between adjacent end walls and sidewalls. Similarly, the protrusion may include rounded, bevelled and/or chamfered edges between end walls and/or sidewalls and the upper wall and/or the lower wall.

In some embodiments, the upper wall and the lower wall of the protrusion may extend substantially parallel to one another.

In other embodiments, the upper wall may include one or more curves. For example, in some such embodiments, the upper wall may include one or more convex or concave curves.

In some such embodiment, the upper wall of the protrusion may include a concave curve extending longitudinally between the opposed end walls. In such embodiments, the upper wall may have a substantially V-shaped profile when viewed along a direction perpendicular to one of the opposed sidewalls.

In use, the opposed end walls of the protrusion may at least partially abut against an inner surface of the upper and opposed lower walls of the rail to at least partially prevent axial movement of the vertical member relative to the rail when pivotally coupled together with the coupling member.

In some embodiments, the end walls of the protrusion may include at least a bevelled or rounded upper portion to at least partially facilitate the rail in sliding over the rail engagement opening of the vertical member and the protrusion of the coupling member at least partially protruding therethrough.

In such embodiments, a lip of the opening or a leading opening of the set of opposed openings of the rail may ride over the bevelled or rounded upper portion and cause the coupling member to temporarily depress against a biasing force of the biasing member. Once the lip has passed over the protrusion, the protrusion may again be biased outwardly of the rail engagement opening at least partially towards an inner surface of one of the opposed sidewalls of the rail to pivotally couple the vertical member and the rail together.

In preferred such embodiments, the lip of the opening or the leading opening of the set of opposed openings of the rail may provide tactile and/or audible feedback to an installer as it rides over the concave-shaped upper wall of the protrusion. Specifically, the feedback may be characterised by an initial bias as the lip slides down a declining surface of the upper wall into a trough of the concave-shaped upper wall and then a subsequent resistance as the lip is slid up an inclining surface of the upper wall and over the edge between the upper wall and the adjacent end wall.

Any suitable biasing member may be used for biasing the protrusion of the coupling member outwardly from the rail engagement opening in the vertical member under a biasing force of the biasing member.

For example, in some embodiments, the biasing member may include one or more springs, such as coil or leaf springs.

In other embodiments, the biasing member may include magnets or magnetized elements. For example, the biasing member may include a pair of opposed magnetic elements each fastened to one of the coupling member and an inner surface of the vertical member opposite the rail engagement opening. The opposed magnetic elements may be arranged in a state of repulsion relative to one another, preferably such that the coupling member is repelled away from the inner surface of the vertical member opposite the rail engagement opening and biased outwardly of the rail engagement opening.

In some embodiments, the at least one coupling member may include at least one leg extending away from the at least one protrusion and adapted to abut against an inner surface of the vertical member. The at least one leg may preferably extend from the lower wall of the protrusion.

The at least one leg may be of any suitable size and shape, preferably curved in shape. The at least one leg may include an outer end and a foot operatively associated with the outer end.

Preferably, the at least one leg may be of unitary construction with the at least one protrusion of the coupling member.

In some embodiments, the at least one leg and the at least one protrusion may be interconnected by a web. In such embodiments, the web may function as a biasing member for biasing the leg away from the at least one protrusion. The fitting of the coupling member at least partially into the vertical member may squeeze the at least one leg at least partially towards the at least one protrusion against the biasing force of the web.

In other embodiments, the at least one leg may by substantially arcuate in shape curving outwardly and away from the lower wall of the protrusion. In such embodiments, the arcuate shape of the leg may function as a biasing member for biasing the leg away from the at least one protrusion. The fitting of the coupling member at least partially into the vertical member may flex the at least one leg at least partially towards the at least one protrusion and store potential energy in the flexing leg which is exerted as the biasing force for biasing the at least one protrusion outwardly from the rail engagement opening.

In some embodiments, the at least one leg may further include one or more flexion points to at least partially assist in flexing of the leg at least partially towards the at least one protrusion against the biasing force of the web or the potential energy stored in the arcuately shaped leg.

In some preferred embodiments, the at least one coupling member may include a pair of arcuately shaped opposed legs curving outwards and away from a location mid-way along the lower wall of the at least one protrusion. In such embodiments, the arcuate shape of the legs may function as a biasing member for biasing the legs away from the at least one protrusion.

The pair of arcuately shaped legs and the lower wall of the at least one protrusion may further be interconnected by a flexion point adapted to bias the legs outwards and away from one another. In such embodiments, the fitting of the coupling member at least partially into the vertical member may flex the legs at least partially towards one another and at least partially towards the at least one protrusion. The potential energy stored in the flexing legs and the flexion point may together exert a biasing force for biasing the at least one protrusion outwardly from the rail engagement opening.

In other preferred embodiments, the at least one coupling member may form part of a cap for an end of the vertical member.

In such embodiments, the at least one coupling member may include a pair of protrusions adapted to each respectively protrude from rail engagement openings defined in opposed outwardly facing sidewalls at or near the end of the vertical member. The protrusions and the cap may be interconnected by a pair of arcuately shaped legs adapted to function as biasing members for biasing the protrusions outwardly from each respective rail engagement opening. The pair of arcuately shaped legs may curve outwards and away from one another from an underside of the cap.

In such embodiments, the fitting of the cap and coupling members may include the flexing of the protrusions and legs at least partially towards each other as the cap is fitted into the end of the vertical member thereby storing potential energy in the flexing of the legs which is exerted as a biasing force for biasing the protrusions outwardly from the respective rail engagement openings.

The cap may include a rounded, or partially rounded, outer surface to at least partially facilitate pivoting of the rail relative to the end of the vertical member.

In some embodiments, the outer surface of the cap may be at least partially deformable to facilitate pivoting of the rail relative to the end of the vertical member.

In some embodiments, the at least one coupling member may further include one or more positioning members to at least partially assist in positioning the coupling member relative to the vertical member and the rail engagement opening.

The one or more positioning members may be of any suitable size, shape and construction.

In preferred embodiments, the one or more positioning members may be in the form of a foot, as previously described, and located at the bottom of one or both of the legs of the coupling member.

For example, in some embodiments, the foot may at least partially abut against the inner surface of at least one of the pairs of sidewalls of the vertical member to align and position the at least one protrusion of the coupling member relative to the rail engagement opening. Preferably, the foot may extend transversely across the outer end of the leg and at least partially abut against an inner surface of both sidewalls of the vertical member.

In some embodiments, the assembly may further include one or more closing members configured to be slidingly received in the rail to at least partially close, or cover, any gap defined between an elongate opening and the vertical member received therethrough.

The closing member may be of any suitable size, shape and construction and may be formed from any suitable material or materials.

Generally, the closing member may be formed from plastic or metal material or materials, preferably metal material or materials.

Typically, the closing member may be an elongate member configured to be received within the rail and extend at least partially along a length of the rail, preferably along a length of the lower or upper wall of the rail.

As indicated, the closing member may preferably be adapted to be slidable relative to the rail to close, or cover, any gap defined between at least one elongate opening and the vertical member received therethrough, preferably a plurality of elongate openings.

The closing member may include a base wall having a front edge, an opposed rear edge and pair of opposed side edges extending longitudinally therebetween. The base wall may include a pair of opposed surfaces extending substantially parallel to one another.

The closing member may include a plurality of openings defined along a length of the closing member in a spaced arrangement. The plurality of openings may preferably correspond to and at least partially align with the elongate openings defined in either the upper or lower wall of the rail.

In use, the vertical members may be at least partially received through the elongate opening in the rail and the openings in the closing member. The closing member may then be slid relative to the rail to at least partially close any gap defined between an edge of the elongate opening and the vertical member received therethrough.

In some embodiments, the base wall may include a pair of opposed sidewalls orthogonally extending from the respective side edges and extending longitudinally between the front edge and the opposed rear edge. The sidewalls may advantageously at least partially assist in aligning, and/or maintaining, the base wall of the closing member relative to the upper or lower wall of the rail. In some such embodiments, the sidewalls may assist in maintaining one of the opposed surfaces of the base wall of the closing member in at least partial abutment with an inner surface of the upper or lower wall of the rail.

According to a fourth aspect of the present invention, there is provided a method of assembling a rackable panel, said method including:

- providing a rackable panel assembly in accordance with the first or second aspects;
- inserting at least one coupling member into each vertical member so that the at least one protruding member is aligned relative to the rail engagement opening; and
- mounting the vertical members to the at least one rail by individually inserting each vertical member through the opening or openings defined in the rail until the rail covers the rail engagement opening and the at least one protrusion protrudes at least partially outwards from the rail engagement opening in a direction perpendicular to a length of the at least one rail to pivotally couple the vertical member to the at least one rail.

The method may include one or more characteristics or features of the assembly or coupling member as hereinbefore described.

The inserting may include inserting the at least one coupling member via the end of the vertical member or via the rail engagement opening.

In some embodiments, the inserting may include aligning the at least one coupling member relative to the end of the vertical member or the rail engagement opening such that the at least one protrusion is substantially aligned relative to the rail engagement opening.

In preferred embodiments, the inserting may include flexing the at least one leg of the coupling member at least partially towards the at least one protrusion.

The mounting may include aligning each vertical member relative to an opening or set of openings defined along a length of the rail.

For example, when mounting the vertical members to a top or bottom rail, the mounting may include aligning each vertical member relative a single respective opening defined in the rail and inserting the respective upper end or lower end into the opening.

Conversely, when mounting the vertical members to a rail positioned between the top and the bottom of the panel, the mounting may include aligning each vertical member to a set of opposed openings defined in the upper and lower walls of the rail and inserting the vertical member through the opposed openings.

The mounting may preferably include inserting the vertical members through the opening or openings until the rail covers the rail engagement opening and the coupling member fitted therein. Once the rail engagement opening is covered by the rail, the at least one protrusion, biased outwardly of the rail engagement opening, may pivotally couple the vertical member to the rail.

According to a fifth aspect of the present invention, there is provided a rackable panel when assembled by the method of the fourth aspect.

According to a sixth aspect of the present invention, there is provided a method of assembling a rackable fence, said method including:

providing at least one rackable panel assembly in accordance with the first or second aspects;

erecting at least two fence posts relative to a support surface; and mounting the at least one rackable panel assembly to the at least two fence posts so that the at least one rail of the panel assembly extends substantially parallel to a slope or gradient of the support surface.

The method may include one or more characteristics or features of the assembly, the coupling member and the panel as hereinbefore described.

The mounting may include connecting the ends of the at least one rail to the respective fence posts, either directly or indirectly. Preferably, the mounting may include pivotally connecting the at least one rail to the fence posts so that the rail may be angled relative to the fence posts to extend substantially parallel with the slope or gradient of the support surface.

In some embodiments, the mounting may include pivoting the at least one rail relative to the vertical members such that the rail extends substantially parallel with the slope or gradient of the support surface and the vertical members remain generally upright, preferably substantially vertically orientated.

According to a seventh aspect of the present invention, there is provided a rackable fence when assembled by the method of the sixth aspect.

Any of the features described herein can be combined in any combination with any one or more of the other features described herein within the scope of the invention.

The reference to any prior art in this specification is not and should not be taken as an acknowledgement or any form of suggestion that the prior art forms part of the common general knowledge.

BRIEF DESCRIPTION OF DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION

Figure 1B:
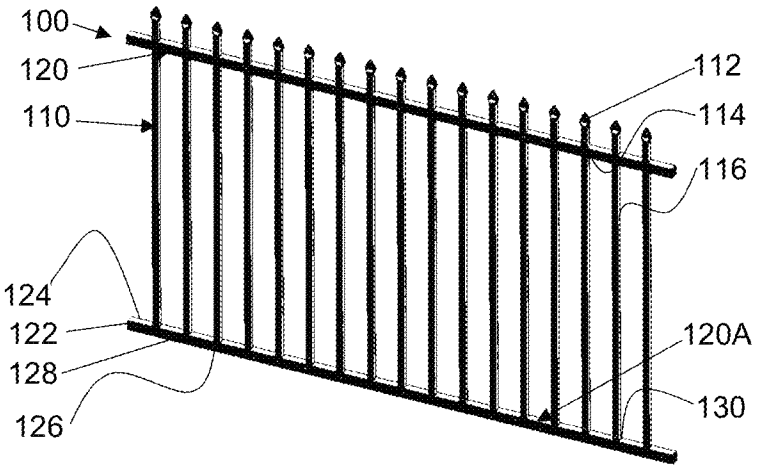
FIGS. 1A to 1F show upper perspective views of rackable fence panel assemblies according to embodiments of the present invention, each assembly including a plurality of pickets pivotally coupled to two or more rails.

FIGS. 1A to 1F and 2 to 11 show a rackable fence panel assembly (100) and parts thereof according to various embodiments of the present invention.

Referring to FIGS. 1A to 1F, each of the embodiments of rackable fence assemblies (100) shown comprises a plurality of pickets (110; i.e., vertical members) and two or more rails (120) pivotally coupled together. The pickets (110) and rails (120) are pivotally coupled together such that the rails (120) are able to extend substantially parallel with a slope or gradient of an underlying support surface between adjacently positioned fence posts (not shown), while the pickets (110) remain generally upright.

Each of the plurality of pickets (110) includes a pair of opposed ends (112) and four walls extending longitudinally therebetween. The four walls include a pair opposed sidewalls (114) and a pair of opposed outwardly facing walls (116).

Each rail (120) has a pair of opposed ends (122) and four walls extending longitudinally therebetween. The four walls include an upper wall (124), an opposed lower wall (126) and opposed sidewalls (128). The opposed ends (122) are pivotally connectable to adjacently positioned fence posts (not shown) so that the rails (120) can be angled relative to the fence post to extend substantially parallel with the slope or gradient of an underlying support surface.

Each rail (120) further includes openings or sets of opposed openings (130) defined in the upper and/or lower walls (124, 126) and spaced along a longitudinal length of the rail (120). Each opening (130) or set of openings (130) is adapted to receive a picket (110) therein or therethrough.

Each picket (110) is pivotally coupled to a rail (120) with a coupling member (150; not visible) that enables the rails (120) to pivot relative to a horizontal plane between 0° and about ±35° while the pickets (110) remain generally vertical.

The coupling member (150; not visible) will be described in detail with reference to FIGS. 2 to 11 later.

The pickets (110) and rails (120) are formed from metal and are of tubular construction.

Figure 1A:
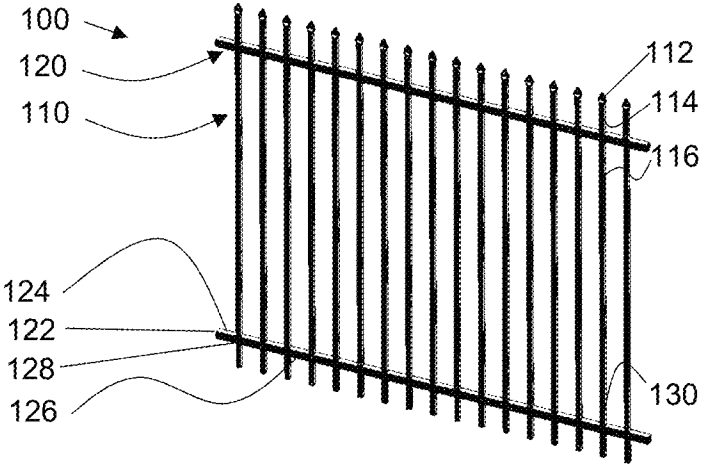

Referring to FIG. 1A, in this embodiment the pickets (110) extend through both rails (120) such that the ends (112) of the pickets (110) protrude past the rails (120) and define an upper and lower end of the assembly (100).

The rails (120) includes sets of opposed openings (130) spaced along the length of each rail (120) for receiving a picket (110) therethrough. The openings (130) are formed in the upper and lower walls (124, 126) of each rail (120).

The openings (130) defined in the lower wall (126) of each rail (120) are elongate so that pickets (110) received therethrough are able to be pivoted relative to the rails (120). The openings (130) are elongate in a dimension extending substantially parallel with a longitudinal axis of the rail (120).

As shown, the upper ends (112) of the pickets (110) are crimped and trimmed to be pointed.

FIG. 1B shows another embodiment of the assembly (100). For convenience, features that are similar or correspond to features of the embodiment shown in FIG. 1A will be referenced with the same reference numerals.

In this embodiment, the assembly (100) again comprises a plurality of pickets (110) pivotally coupled to two rails (120), including a lower rail (120A) defining a lower end of the assembly (100) and a rail (120) extending substantially parallel to the lower rail (120A) near an upper end (112) of the pickets (110).

The lower rail (120A) comprising openings (130) defined only in the upper wall (124) for receiving the ends (112) of the pickets (110) therethrough. The ends (112) do not extend through the lower rail (120A). The openings (130) defined in the upper wall (124) of the lower rail (120A) are elongate so that the pickets (110) received therein are able to be pivoted relative to the rails (120).

Figure 1C:
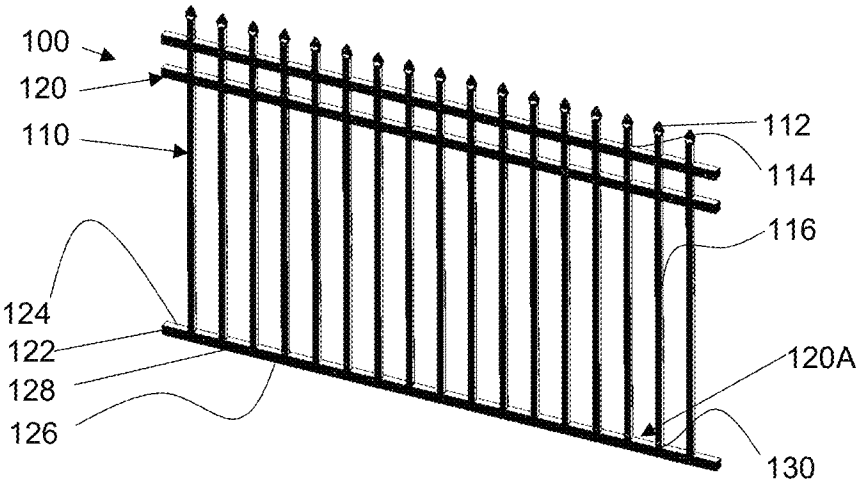

FIG. 1C shows another embodiment of the assembly (100). For convenience, features that are similar or correspond to features of the embodiment shown in FIGS. 1A and 1B will be referenced with the same reference numerals.

In this embodiment, the assembly (100) comprises a plurality of pickets (110) pivotally coupled to three rails (120), including a lower rail (120A) defining a lower end of the assembly (100) and a pair of rails (120) extending parallel to one another and the lower rail (120A) near an upper end (112) of the pickets (110).

Figure 1E:
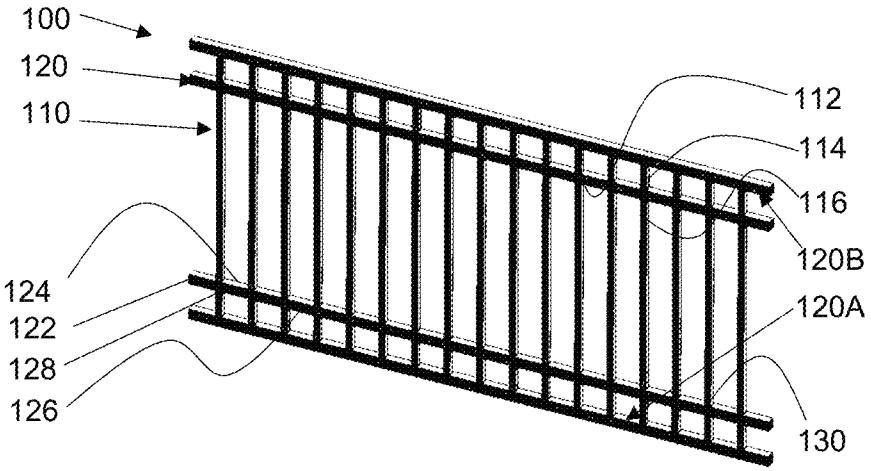
Figure 1D:
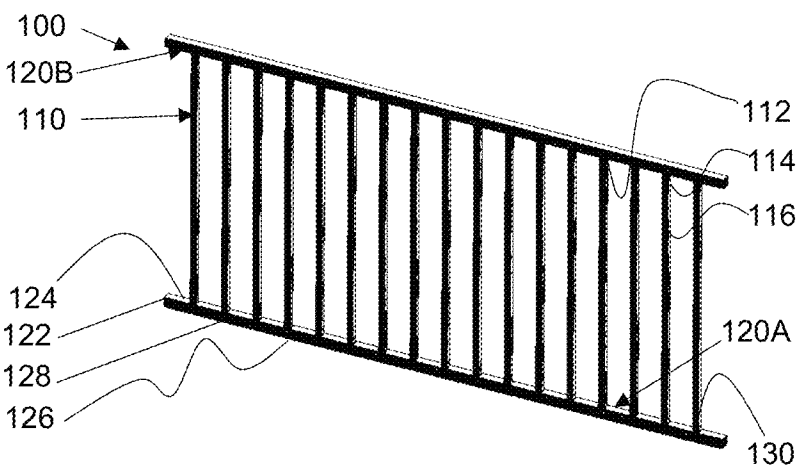

FIG. 1D shows another embodiment of the assembly (100). For convenience, features that are similar or correspond to features of the embodiment shown in FIGS. 1A to 1C will be referenced with the same reference numerals.

In this embodiment, the assembly (100) again comprises a plurality of pickets (110) pivotally coupled to two rails (120), including a lower rail (120A) defining a lower end of the assembly (100) and an upper rail (120B) defining an upper end of the assembly (100).

The upper rail (120B), like the lower rail (120A), comprising openings (130) defined only in the lower wall (126) for receiving the ends (112) of the pickets (110) therethrough. The ends (112) do not extend through the upper rail (120B). The openings (130) defined in the lower wall (126) of the upper rail (120B) are elongate so that the pickets (110) received therein are able to be pivoted relative to the rails (120A, 120B).

FIG. 1E shows another embodiment of the assembly (100). For convenience, features that are similar or correspond to features of the embodiment shown in FIGS. 1A to 1D will be referenced with the same reference numerals.

In this embodiment, the assembly (100) again comprises a plurality of pickets (110) pivotally coupled to four rails (120), including a lower rail (120A) defining a lower end of the assembly (100), an upper rail (120B) defining an upper end of the assembly (100) and a pair of rails (120) extending parallel to the lower and upper rails (120A, 120B).

Figure 1F:
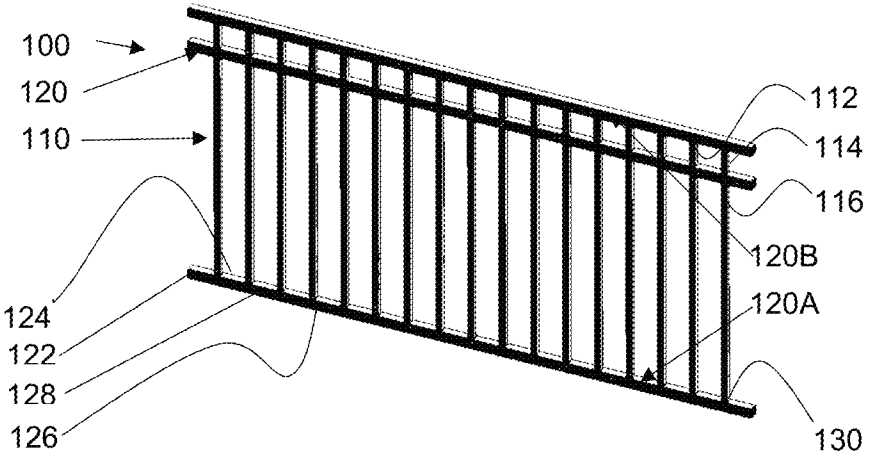

FIG. 1F shows another embodiment of the assembly (100). For convenience, features that are similar or correspond to features of the embodiment shown in FIGS. 1A to 1E will be referenced with the same reference numerals.

In this embodiment, the assembly (100) again comprises a plurality of pickets (110) pivotally coupled to three rails (120), including a lower rail (120A) defining a lower end of the assembly (100), an upper rail (120B) defining an upper end of the assembly (100) and a single rail (120) extending parallel to the upper rail (120B).

FIGS. 2 to 6 show an embodiment of the coupling member (150) for pivotally coupling a picket (110) to a rail (120) in which the pickets (110) extend through the rail (120), e.g., as shown in FIG. 1A.

Figure 2:
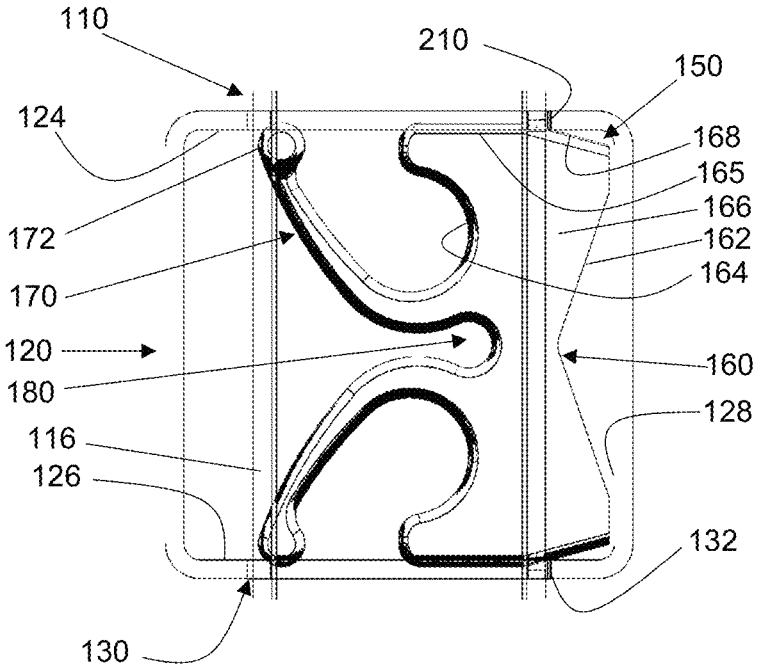
FIG. 2 is a sectional end view of a picket pivotally coupled to a rail with a coupling member according to an embodiment of the present invention, and when looking down the end of the rail.
Figure 3:
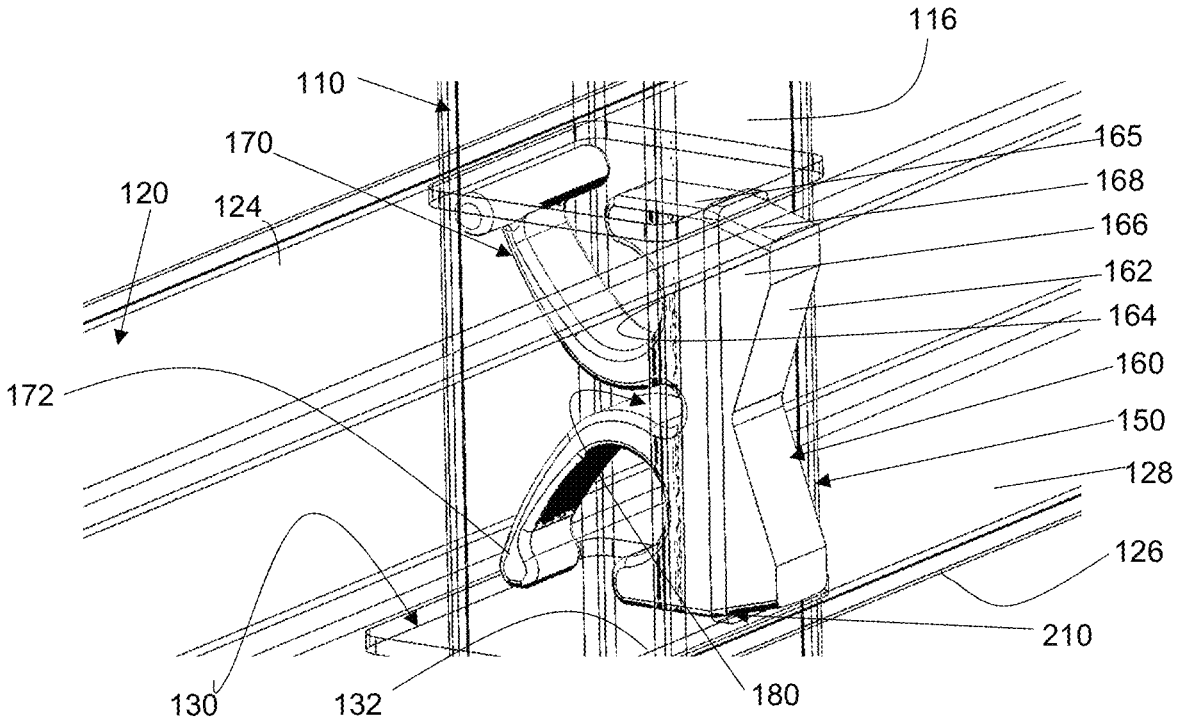
FIG. 3 is an upper perspective view of the picket pivotally coupled to the rail as shown in FIG. 2.

Referring to FIGS. 2 and 3, the coupling member (150) includes at least one protrusion (160) and a biasing member in the form of a pair of legs (170) extending away from the protrusion (160) for biasing the protrusion (160) at least partially outwards from a rail engagement opening (210) defined in one of the outwardly facing walls (116) of each picket (110) for pivotally coupling the picket (110) to the rail (120). The protrusion (160) and legs (170) are of unitary construction.

As shown, the rail engagement opening (210) is configured to be covered by the rail (120) when the picket (110) is pivotally coupled to the rail (120).

The rail engagement opening (210) is an elongate opening extending longitudinally in a direction at least partially along a length of the picket (110).

Figure 6:
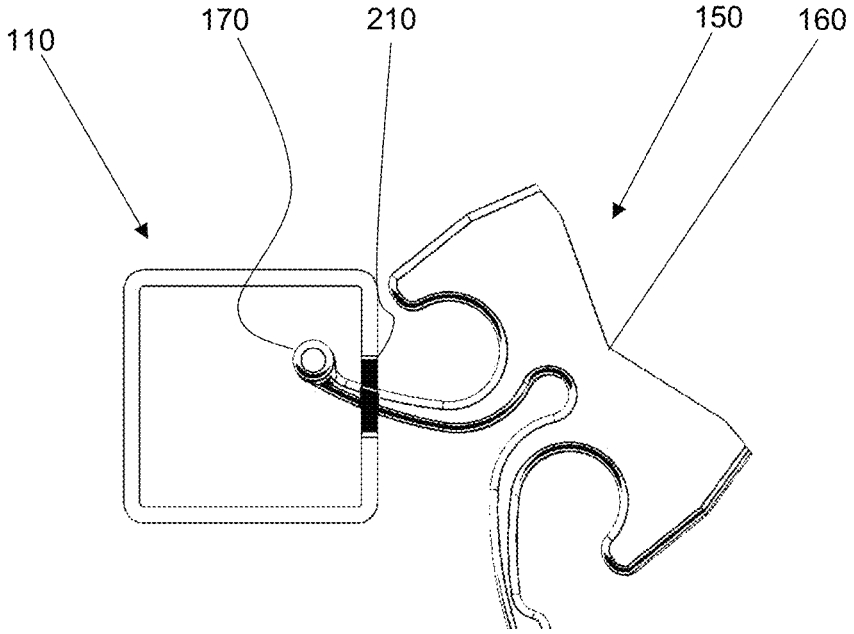
FIG. 6 is a perspective view of a coupling member being fitted to a picket.

Referring briefly to FIG. 6, the coupling member (150) is sized and shaped to be at least partially received in the picket (110) via the rail engagement opening (210). In use, the legs (170) are inserted into the rail engagement opening (210) and the coupling member (150) is then aligned such that the protrusion (160) at least partially protrudes outwardly from the rail engagement opening (210).

Referring back to FIGS. 2 and 3, the protrusion (160) in use protrudes outwardly from the rail engagement opening (210) in a direction perpendicular to a length of the rail (120) towards an inner surface of one of the pair of opposed sidewalls (128) of the rail (120).

The protrusion (160) has an elongate shape sized and shaped to correspond to the shape and size of the rail engagement opening (210) and at least partially protrude through the rail engagement opening (210).

The protrusion (160) includes an outer wall (162, i.e., an upper wall) and an opposed inner wall (166, i.e., a lower wall) interconnected by a pair of opposed end walls (165) and a pair of opposed sidewalls (166) extending longitudinally therebetween.

The protrusion (160) includes bevelled edges (168) between the outer wall (162) and the end walls (165).

The outer wall (162) is characterised by a concave surface extending longitudinally between the opposed end walls (165). As shown in FIG. 2, the outer wall (162) has a substantially V-shaped profile when viewed along a direction perpendicular to one of the opposed sidewalls (166).

In use, the opposed end walls (165) of the protrusion (160) at least partially abut against an inner surface of the upper and opposed lower walls (124, 126) of the rail (120) to at prevent axial movement of the picket (110) relative to the rail (120) when pivotally coupled together with the coupling member (150).

When coupling a picket (110) and rail (120) together, the bevelled edges (168) at least partially facilitate the rail (120) in sliding over the rail engagement opening (210) of the picket (110) and the protrusion (160) of the coupling member (150) at least partially protruding therethrough.

Specifically, a lip (132) of a leading opening (130) of the set of opposed openings (130) of the rail (120) slides or rides over the bevelled edge (168) and causes the coupling member (150) to temporarily depress against a biasing force of the biasing member. Once the lip (132) has passed over the protrusion (160), the protrusion (160) is again biased outwardly of the rail engagement opening (210) towards an inner surface of a sidewall (128) of the rail (120) to pivotally couple the picket (110) and the rail (120) together.

Advantageously, the coupling member (150) provides tactile and/or audible feedback to an installer when coupling a picket (110) and rail (120) together. Specifically, feedback is provided as the lip (132) of the leading opening (130) of the set of opposed openings (130) of the rail (120) slides or rides over the concave-shaped outer wall (162) of the protrusion (160). The feedback is characterised by an initial bias as the lip (132) slides down a declining surface of the outer wall (162) into a trough of the concave-shaped outer wall (162) and then a subsequent resistance as the lip (132) slides up an inclining surface of the outer wall (162) and over the bevelled edge (168) between the outer wall (162) and the adjacent end wall (165).

As indicated, the coupling member (150) includes a biasing member in the form of a pair of legs (170) extending away from the protrusion (160) for biasing the protrusion (160) at least partially outwards from the rail engagement opening (210).

The pair of legs (170) are substantially arcuate in shape and curve outwards and away from mid-way along the inner wall (164) of the protrusion (160). Each leg (170) includes a foot (172) operatively associated with an outer end of the leg (170). The foot (172) is adapted to abut against an inner surface of the outwardly facing wall (116) of the picket (110) opposite the rail engagement opening (210).

The pair of legs (170) and the inner wall (164) of the protrusion (160) are interconnected by a flexion point (180) adapted to bias the legs (170) outwards and away from one another.

Advantageously, the fitting of the coupling member (150) at least partially into the picket (110) flexes the legs (170) at least partially towards one another and at least partially towards the protrusion (160) storing potential energy in the flexed legs (170). Together, the flexed legs (170) and the flexion point (180) together exert a biasing force for biasing the protrusion (160) outwardly from the rail engagement opening (210).

Figure 4:
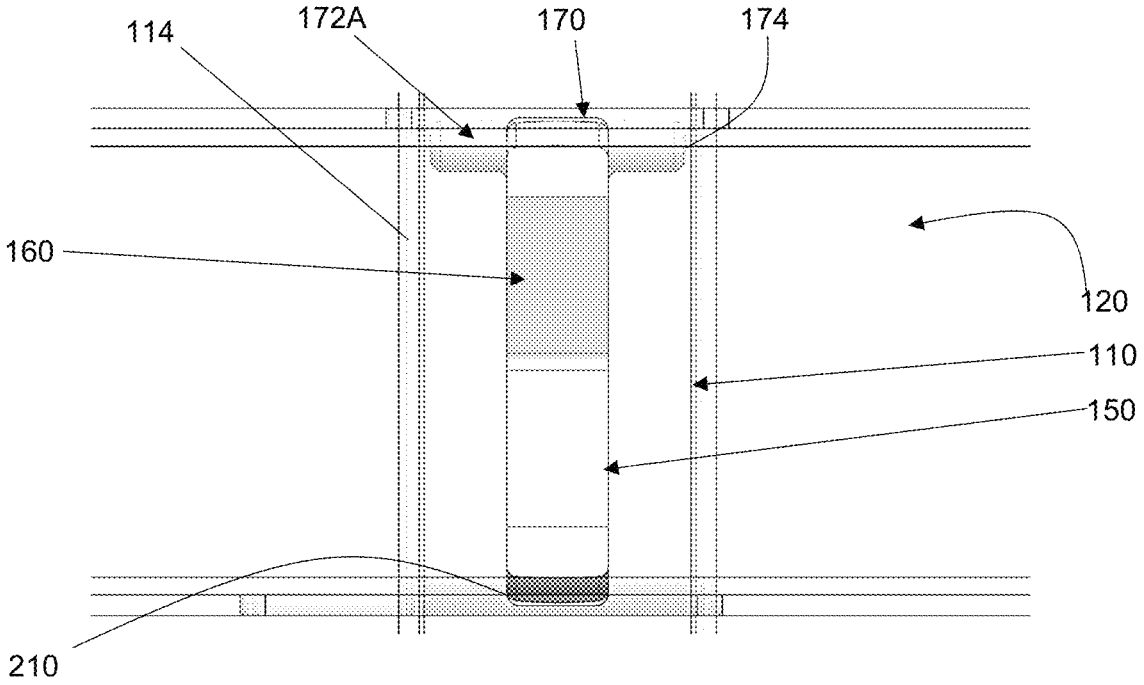
FIG. 4 is a front view of the picket pivotally coupled to the rail as shown in FIGS. 2 and 3.
Figure 5:
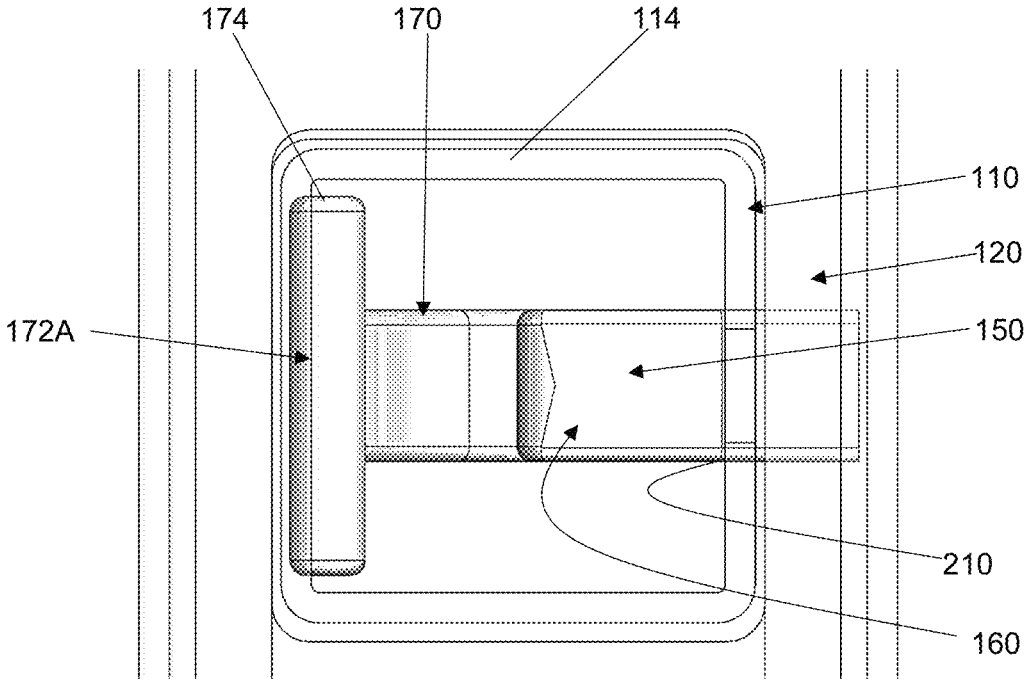
FIG. 5 is another sectional end view of the picket pivotally coupled to the rail as shown in FIGS. 2 to 4 when looking down the end of the picket.

Referring to FIGS. 4 and 5, at least one foot (172A) of one of the legs (170) further functions as a positioning member for positioning the protrusion (160) of the coupling member (150) relative to the picket (110) and the rail engagement opening (210).

As shown, the foot (172A) extends longitudinally between a pair of opposed ends (174) and is sized and shaped to centre the protrusion (160) relative to the rail engagement opening (210). Specifically, the foot (172A) extends transversely across the outer end of the leg (170) with each end (174) extending towards a respective sidewall (114) of the picket (110).

Figure 7:
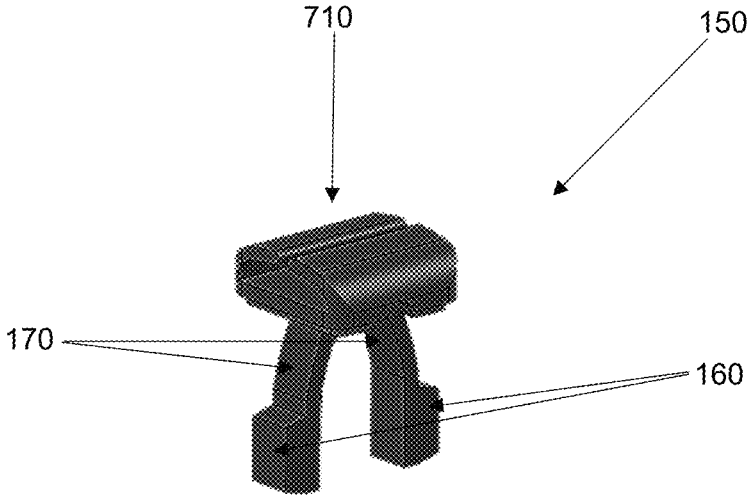
FIG. 7 is an upper perspective view of another coupling member according to an embodiment of the present invention.
Figure 8:
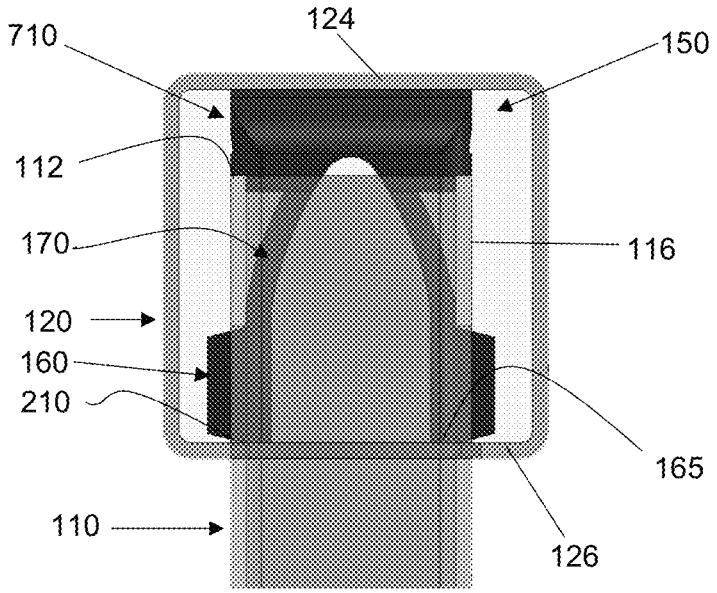
FIG. 8 is a sectional end view of a picket pivotally coupled to a rail with the coupling member as shown in FIG. 7.
Figure 9:
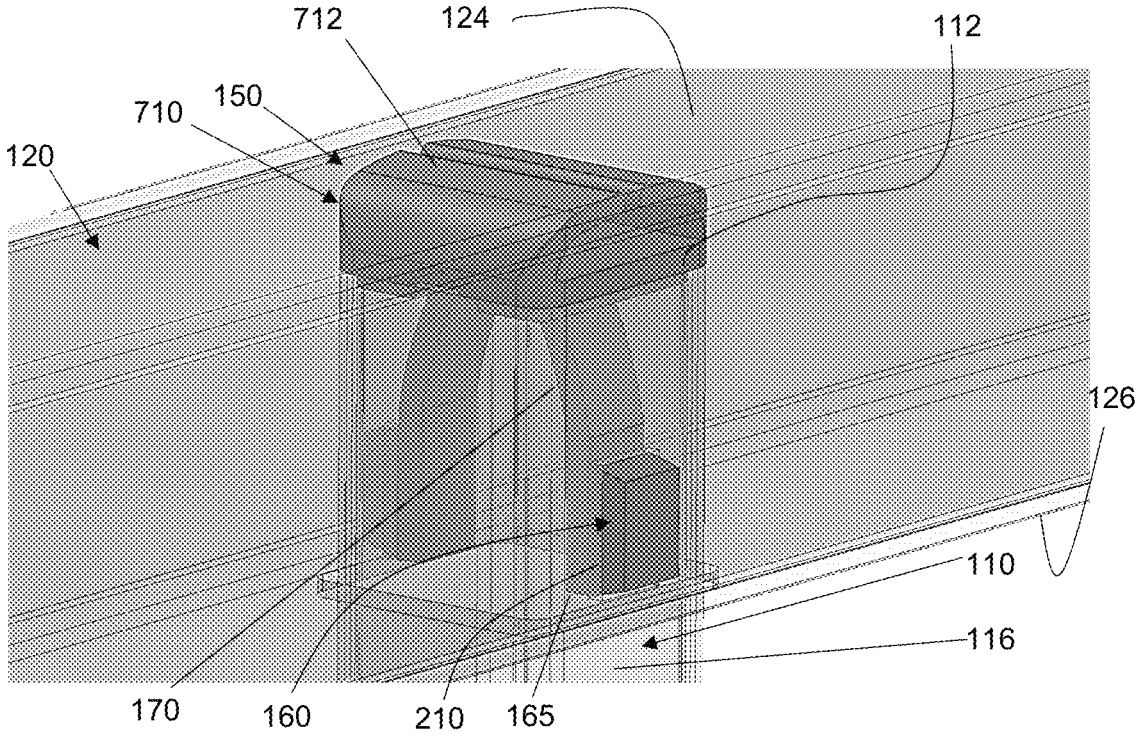
FIG. 9 is an upper perspective view of the picket pivotally coupled to the rail as shown in FIG. 8.

FIGS. 7 to 9 show an embodiment of the coupling member (150) for pivotally coupling a picket (110; shown only in FIGS. 8 and 9) to a rail (120; shown only in FIGS. 8 and 9) in which the end (112; shown only in FIGS. 8 and 9) of the picket (110; shown only in FIGS. 8 and 9) is received in the rail (120; shown only in FIGS. 8 and 9) and not through the rail (120; shown only in FIGS. 8 and 9), such as, e.g., with the lower rail (120A) and the upper rail (120B) as shown in FIGS. 1B to 1F. For convenience, features that are similar or correspond to features of the embodiment shown in FIGS. 2 to 6 will be referenced with the same reference numerals.

Referring to FIG. 7, in this embodiment the coupling member (150) forms part of a cap (710) for the end (112) of a picket (110).

The coupling member (150) includes the cap (710), a pair of protrusions (160) and a pair of arcuately shaped legs (170), each adapted to function as a biasing member and interconnect the cap (710) and a respective protrusion (160). The cap (710), protrusions (160) and legs (170) are of unitary construction.

Referring to FIGS. 8 and 9, the coupling member (150) is adapted to be fitted to a picket (110) via its end (112). The protrusions (160) are adapted to be biased at least partially outwards of opposed rail engagement openings (210) defined in the opposed outwardly facing walls (116) near the end (112) of the picket (110).

As shown, the rail engagement openings (210) are configured to be covered by the rail (120) when the picket (110) is pivotally coupled to the rail (120).

The end wall (165) of the protrusion (160) and the cap (710) at least partially abut against the inner surfaces of the upper and lower walls (124, 126) of the rail (120) to at least partially prevent axial movement of the picket (110) relative to the rail (120) when pivotally coupled together with the coupling member (150).

In use, the fitting of the cap (710) and coupling member (150) includes flexing of the protrusions (160) and legs (170) at least partially towards each other as the cap (710) is fitted at least partially into the end (112) the picket (110) thereby storing potential energy in the flexed legs (170). The stored potential energy is exerted as a biasing force for biasing the protrusions (160) outwardly from the respective rail engagement openings (210).

Best shown in FIG. 9, the cap (710) includes partially rounded and deformable outer wall (712) to at least partially facilitate pivoting of the picket (110) and rail (120) relative to one another.

Figure 10:
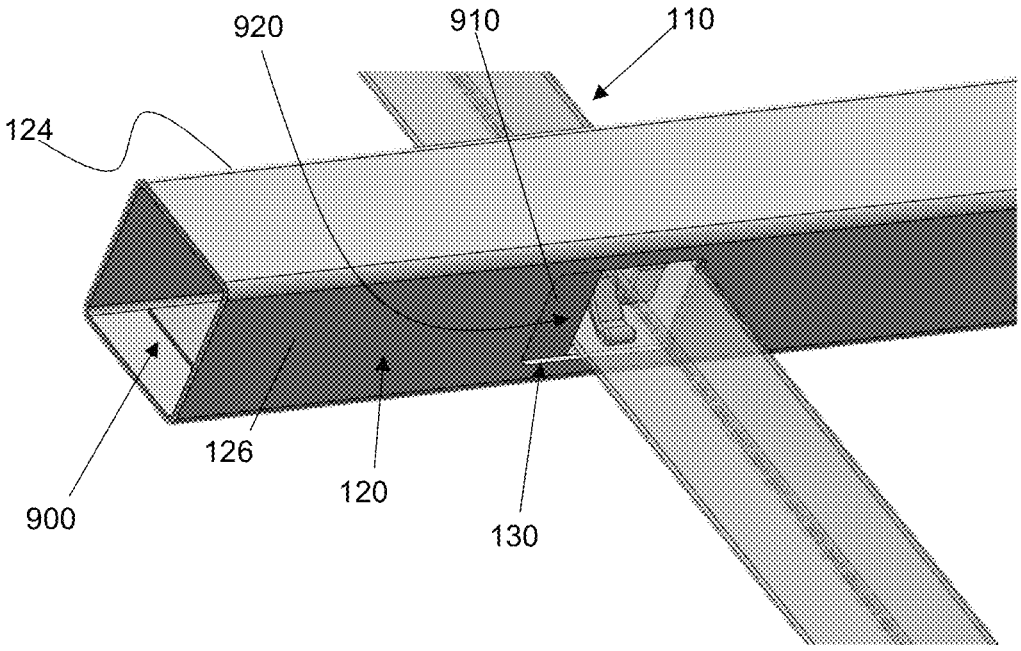
FIG. 10 is an upper perspective view of a picket pivotally coupled to a rail in accordance with an embodiment of the present invention.
Figure 11:
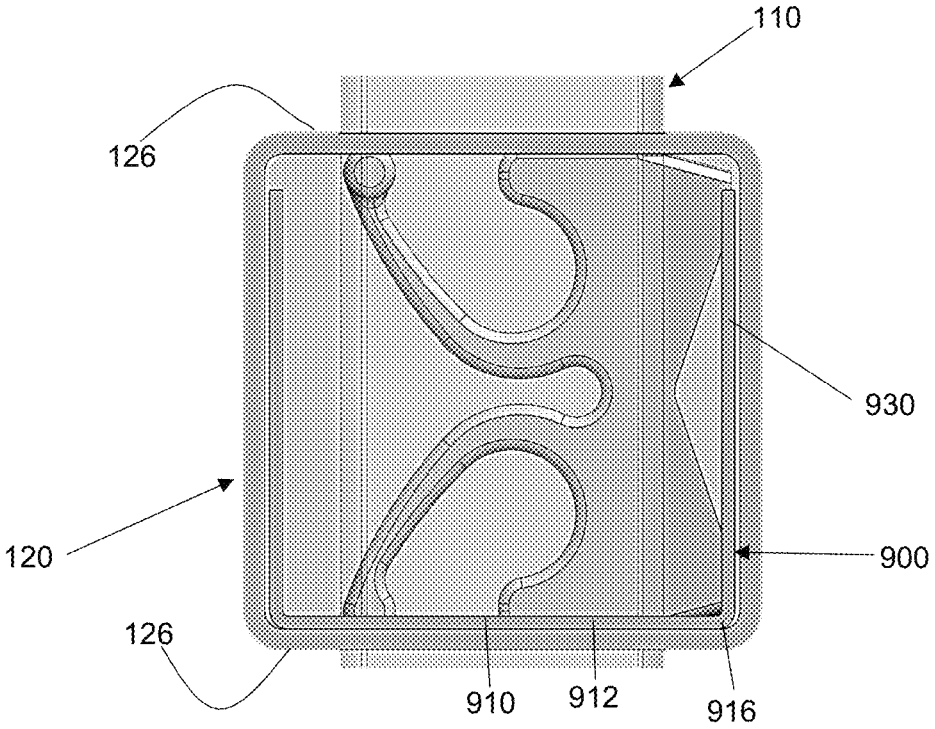
FIG. 11 is a sectional end view of the picket pivotally coupled to the rail as shown in FIG. 10.

FIGS. 10 and 11 show a closing member (900) configured to be slidingly received in the rail (120) to at least partially cover any gap defined between an opening (130) and the picket (110) received therethrough.

The closing member (900) is formed from plastic or metal material or materials.

The closing member (900) is elongate and configured to at least partially extend along a length of the rail (120). Specifically, along a length of either the lower or upper wall (124, 126) of the rail (120), whichever has the elongate openings (130; visible only in FIG. 10) defined therein.

The closing member (900) includes a base wall (910) having a front edge (912; visible only in FIG. 11), an opposed rear edge (914; not shown) and pair of opposed side edges (916; visible only in FIG. 11) extending longitudinally therebetween. The base wall (910) includes a pair of opposed surfaces extending substantially parallel to one another.

The closing member (900) includes a plurality of openings (920; visible only in FIG. 10) defined along a length of the closing member (900) in a spaced arrangement. The openings (920; visible only in FIG. 10) correspond to and at least partially align with the elongate openings (130; visible only in FIG. 10) defined in either the upper or lower walls (124, 126) of the rail (120).

In use, the pickets (110) are at least partially received through the elongate opening (130) in the rail (120) and the openings (920) in the closing member (900). The closing member (900) is then be slid relative to the rail (120) to offset the openings (920, 130; visible only in FIG. 10) and at least partially close any gap defined between an edge of the elongate opening (130; visible only in FIG. 10) and the picket (110) received therethrough.

As shown, the base wall (910) further includes a pair of opposed sidewalls (930) orthogonally extending from the respective side edges (916) and extending longitudinally between the front edge (912) and the opposed rear edge (914; not shown). The sidewalls (930) advantageously assist in aligning, and/or maintaining, the base wall (910) of the closing member (900) relative to the upper or lower wall (124, 126) of the rail (120).

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A rackable panel assembly comprising:

a plurality of vertical members each having a pair of opposed ends and at least one sidewall extending longitudinally therebetween and having a rail engagement opening defined therein;

at least one rail having a pair of opposed ends and at least an upper wall and an opposed lower wall extending longitudinally therebetween, said upper wall and said lower wall defining sets of opposed openings spaced along a longitudinal length of the at least one rail, each set of opposed openings comprising an upper wall opening formed in the upper wall and a corresponding lower wall opening formed in the lower wall and defining a through passage extending between the upper wall opening and the lower wall opening adapted to receive a vertical member of said plurality of vertical members therethrough and at least partially overlap or cover the rail engagement opening of said vertical member; and a plurality of coupling members, wherein at least one coupling member of the plurality of coupling members is adapted to be at least partially received in each said vertical member for pivotally coupling the vertical member to the at least one rail, said each coupling member having at least one protrusion and a biasing member for biasing the at least one protrusion outwardly from the rail engagement opening in a direction perpendicular to the length of the at least one rail, said at least one protrusion of each coupling member including an upper wall and an opposed lower wall interconnected by a pair of opposed end walls and a pair of opposed sidewalls, wherein at least one of the upper wall opening and the lower wall opening of each set of opposed openings is elongate so that said vertical member received therethrough is pivotable relative to the at least one rail, and wherein the opposed end walls of the at least one protrusion are configured to at least partially abut against an inner surface of the upper wall of the rail and an inner surface of the opposed lower wall of the rail to at least partially prevent axial movement of the vertical member relative to the rail when pivotally coupled together.

2. The assembly of claim 1, wherein the vertical members are pivotable relative to the at least one rail so that the rail can be racked to extend substantially parallel to a slope or gradient of an underlying support surface and the vertical members remain substantially vertical.

3. The assembly of claim 1, wherein the upper wall of the at least one protrusion includes a concave curve extending longitudinally between the opposed end walls.

4. The assembly of claim 3, wherein the upper wall of the at least one protrusion has a substantially V-shaped profile when viewed along a direction perpendicular to one of the opposed sidewalls.

5. The assembly of claim 1, wherein the end walls of the at least one protrusion include bevelled or rounded upper portions to at least partially facilitate the rail in sliding over the rail engagement opening of the vertical member and the at least one protrusion of the coupling member at least partially protruding therethrough.

6. The assembly of claim 1, wherein the biasing member of each coupling member includes at least one leg extending away from the at least one protrusion and is adapted to abut against an inner surface of the vertical member and bias the at least one protrusion outwardly from the rail engagement opening.

7. The assembly of claim 6, wherein the at least one leg is substantially arcuate in shape curving outwardly and away from the lower wall of the at least one protrusion.

8. The assembly of claim 1, wherein the biasing member includes a pair of arcuately shaped opposed legs curving outwards and away from a location mid-way along the lower wall of the at least one protrusion.

9. The assembly of claim 8, wherein the pair of legs are interconnected by a flexion point adapted to bias the legs outwards and away from one another.

10. The assembly of claim 9, wherein in use the pair of legs of each coupling member are flexed at least partially towards one another and towards the at least one protrusion when being inserted into the vertical member and wherein potential energy stored in flexing of the pair of legs and the flexion point together exert a biasing force for biasing the at least one protrusion outwardly from the rail engagement opening.

11. A method of assembling a rackable panel, said method comprising:

providing a rackable panel assembly in accordance with claim 1;

inserting at least one coupling member of the plurality of coupling members into each vertical member so that the at least one protrusion is aligned relative to the rail engagement openings of each vertical member; and mounting the vertical members to the at least one rail by individually inserting each vertical member through each of the sets of opposed openings defined in the rail until the rail covers the rail engagement openings of each vertical member and the at least one protrusion protrudes at least partially outwards from its respective rail engagement opening in a direction perpendicular to a length of the at least one rail to pivotally couple the vertical members to the at least one rail.

12. The method of claim 11, wherein the at least one coupling member inserted within each vertical member is inserted via the rail engagement opening.

* * * * *